US008955182B1

(12) United States Patent
Schiller et al.

(10) Patent No.: US 8,955,182 B1
(45) Date of Patent: Feb. 17, 2015

(54) PERIMETER-WRAPPED MATTRESS AND METHOD OF MANUFACTURE

(75) Inventors: Stephen J. Schiller, Naples, FL (US); Lucien Sammartano, Jupiter, FL (US)

(73) Assignee: Pranasleep, LLC

( * ) Notice: Subject to any disclaimer, the term of this patent is extended or adjusted under 35 U.S.C. 154(b) by 425 days.

(21) Appl. No.: 13/458,022

(22) Filed: Apr. 27, 2012

Related U.S. Application Data

(60) Provisional application No. 61/559,994, filed on Nov. 15, 2011.

(51) Int. Cl.
*A47C 27/15* (2006.01)
*A47C 27/00* (2006.01)

(52) U.S. Cl.
CPC ..... *A47C 27/002* (2013.01); *A47C 27/15* (2013.01)
USPC ..... 5/739; 5/690; 5/717; 5/740; 29/91.1; 29/91.5

(58) Field of Classification Search
CPC ..... A47C 27/002; A47C 27/15
USPC ..... 5/717, 737, 739, 740, 690; 29/91, 91.1, 29/91.5
See application file for complete search history.

(56) References Cited

U.S. PATENT DOCUMENTS 1,559,708 A * 11/1925 Kelsey ..... 5/696
2,826,769 A * 3/1958 Drews ..... 5/717
3,737,929 A * 6/1973 Golembeck ..... 5/739
5,065,485 A * 11/1991 Zocco ..... 29/91.1
5,133,116 A 7/1992 Wagner et al.
6,568,014 B1 5/2003 Sabalaskey et al.
6,662,393 B2 12/2003 Boyd
7,147,106 B2 12/2006 Kowalski et al.
7,191,483 B2 * 3/2007 Hochschild ..... 5/740
7,386,903 B2 6/2008 Hochschild
7,484,282 B2 * 2/2009 Flippin ..... 29/91.1
7,617,556 B2 * 11/2009 Rensink ..... 5/739
7,631,381 B2 * 12/2009 Flippin ..... 5/739
7,644,461 B2 1/2010 Lee
8,074,313 B2 * 12/2011 Marcangelo ..... 5/737
8,776,295 B2 * 7/2014 Myers et al. ..... 5/737
8,800,082 B2 * 8/2014 Kluft et al. ..... 5/717
2003/0000021 A1 1/2003 O'Connell et al.
2011/0191962 A1 8/2011 Frame

FOREIGN PATENT DOCUMENTS

GB 880079 * 10/1961
GB 920161 * 3/1963

* cited by examiner

*Primary Examiner* — Michael Trettel
(74) *Attorney, Agent, or Firm* — Livingston Loeffler, P.A.; Edward M. Livingston, Esq.; Bryan L. Loeffler, Esq.

(57) ABSTRACT

A mattress (22) having a foam core (8) completely extends to the perimeter edges of the mattress wherein side walls (15) of the foam core are compressed inward and held in place using a preferably non-woven strip of fabric (21) or similar non-elastic or non-stretchable material that is wrapped around the side walls of the foam core. A method of wrapping the foam core allows corners (5) of the foam core to be formed under the inward pressure of the non-woven fabric, thereby creating a strong perimeter for the mattress that prevents outward pressure against the sidewalls created by the downward pressure of an individual lying on the mattress from flattening of the mattress by providing more upward pushback against the individual. An optional layer of micro-coil springs (2*a*) may be located within the foam core to provide more buoyancy and springiness in the mattress.

13 Claims, 5 Drawing Sheets

PERIMETER-WRAPPED MATTRESS AND METHOD OF MANUFACTURE

CROSS REFERENCE TO RELATED APPLICATION

This application claims the benefit of U.S. Provisional Patent Application No. 61/559,994, filed Nov. 15, 2011. The patent application identified above is incorporated herein by reference in its entirety to provide continuity of disclosure.

FIELD OF THE INVENTION

This invention relates to mattresses, more particularly, a mattress constructed of foam which extends all of the way to the outer perimeter edge of the mattress and is wrapped with a non-elastic or a non-stretchable material, such as a non-woven cloth, and an optional layer of micro-coil springs to provide more buoyancy and springiness in the mattress.

BACKGROUND OF THE INVENTION

Foam mattresses are designed for pressure management. When an individual lies on a foam mattress, the foam should distribute the individual's body weight evenly across the entire sleeping surface to reduce uncomfortable pressure points. Foam mattresses are typically constructed using multiple layers of foam. Some foam mattresses are constructed out of latex foam, Talalay latex foam, Dunlop latex foam, memory foam and so forth. Many foam mattresses traditionally require a foam encasement comprising foam panels that create a frame around the core of the mattress. There are three common reasons conventional mattresses are made with a foam encasement. The first is to shape the corners of the mattress. The second is to provide lateral support to the mattress core to prevent the mattress core from spreading under the weight of an individual and failing to provide proper support. The third is to provide a sitting edge on the mattress that is sturdy enough to hold an individual sitting on the edge of the mattress.

However, such conventional foam encasements are typically two to four inches wide and are constructed out of a polyurethane foam having a density greater than that of the typically latex foam core, thereby creating a dense uncomfortable ridge around the perimeter edge of the mattress. In addition, polyurethane foam commonly breaks down over time, thereby becoming softer and failing to provide a sturdy sitting edge. An even further problem with foam encasements is that the foam is flexible, thereby allowing the foam core to spread under a user's weight, thereby flattening the mattress.

Therefore, a need exists for a mattress constructed using a method that eliminates the need for conventional foam encasements, provides equal edge-to-edge comfort across the entire mattress, allows the sides and corners of the mattress to be properly shaped and ensures the mattress retains its shape during use, thereby providing long lasting comfort.

The relevant prior art includes the following references:

| Patent No. | Inventor | Issue/Publication Date |
|---|---|---|
| (U.S. Patent References) | | |
| 5,133,116 | Wagner et al. | Jul. 28, 1992 |
| 6,662,393 | Boyd | Dec. 16, 2003 |
| 6,568,014 | Sabalaskey et al. | May 27, 2003 |
| 2003/0000021 | O'Connell et al. | Jan. 02, 2003 |
| 7,147,106 | Kowalski et al. | Dec. 12, 2006 |

-continued

| Patent No. | Inventor | Issue/Publication Date |
|---|---|---|
| 7,386,903 | Hochschild | Jun. 17, 2008 |
| 7,644,461 | Lee | Jan. 12, 2010 |
| 2011/0191962 | Frame | Aug. 11, 2011 |

SUMMARY OF THE INVENTION

The primary object of the present invention is to provide a mattress constructed using a method and system that eliminates the need for conventional foam encasements.

An additional object of the present invention is to provide a mattress constructed using a method and system that provides equal edge-to-edge comfort across the entire mattress.

A further object of the present invention is to provide a mattress constructed using a method and system that allows the edges and corners of the mattress to be properly shaped.

An even further object of the present invention is to provide a mattress constructed using a method and system that prevents flattening of the core and ensures the mattress retains its shape during use, thereby providing long lasting comfort.

The present invention fulfills the above and other objects by providing a mattress constructed using a method wherein a foam core completely extends to the perimeter edges of the mattress. The side walls of the foam core are compressed inward and held in place using a preferably non-woven fabric or similar non-elastic or non-stretchable material that is wrapped around the side walls of the foam core. The method of wrapping the foam core allows the corners of the mattress to be formed under the inward pressure of the non-woven fabric on the side walls of the foam core. Further, the preferably non-woven fabric has no elasticity. This creates a strong perimeter for the mattress that prevents outward pressure against the sidewalls created by the downward pressure of an individual lying on the mattress, thereby preventing flattening of the mattress by providing more upward pushback against the individual. The flattening of the mattress is prevented whether the user is lying on the center of the mattress or sitting on the edge of the mattress. An additional benefit of the method of the present invention is that the non-woven fabric encases staples used to secure flanges of the cover to the side walls of the foam core, thereby preventing the staples from pulling out of the foam core. This is especially important due to the fact that many foam mattresses are used in adjustable beds wherein the mattresses are bent up and down, thereby making such a staple failure more likely.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
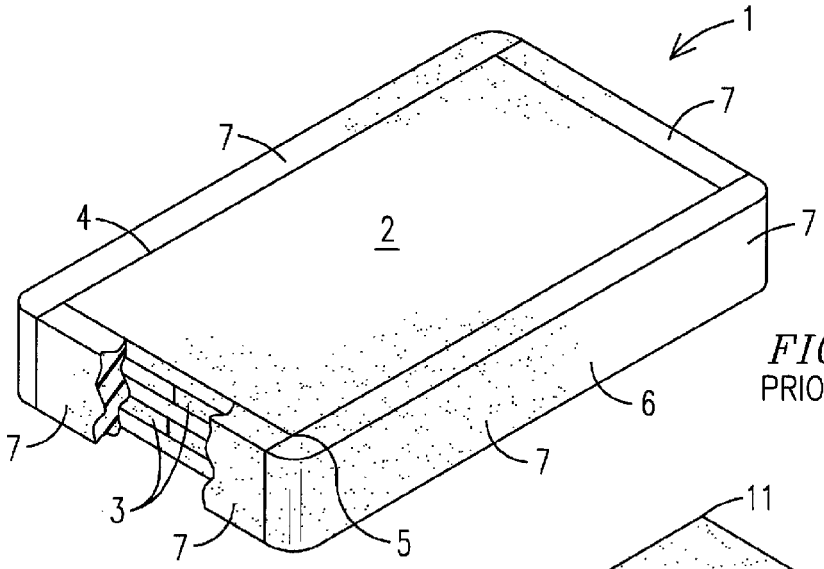
FIG. 1 PRIOR ART
FIG. 1 is a perspective top partial cutaway view of a conventional foam mattress.

For purposes of describing the preferred embodiment, the terminology used in reference to the numbered accessories in the drawings is as follows:

1. conventional foam mattress
2. foam core
3. layer of foam
4. edge of foam core
5. corner of foam core
6. foam encasement
7. foam panel
8. foam core
9*a*. layer of foam
9*b*. micro-coil spring layer
10. edge of foam core
11. corner of foam core
12. bottom cover
13. bottom flange
14. perimeter of bottom cover
15. side wall of foam core
16. top cover
17. upper surface of foam core
18. top flange
19. perimeter of top cover
20. staple
21. non-woven strip of fabric
22. mattress
23. outer surface of top flange
24. adhesive
25. first end of non-woven strip of fabric
26. second end of non-woven strip of fabric
27. side cover panels With reference to FIG. 1, a perspective top partial cutaway view of a conventional foam mattress is illustrated. The conventional foam mattress 1 comprises a foam core 2 made up of various layers of foam 3, preferably latex foam, to create the main body of the mattress 1. The various layers of foam 3 are made up of foams having different densities and qualities. The thickness, firmness and overall quality of the mattress 1 is controlled by layering the different foams throughout the core 2. However, by layering the foam 3, the foam core 2 is left with uneven edges 4 and corners 5. Therefore, the core 2 is surrounded and framed by a foam encasement 6 that is constructed out of foam panels 7 having a height equal to that of the core. By using a foam encasement 6, the edges 4 of the foam core 2 are straight and the corners 5 are rounded correctly. However, there are many disadvantages of using conventional foam encasements 6 which are discussed above in the background section.

Figure 2A:
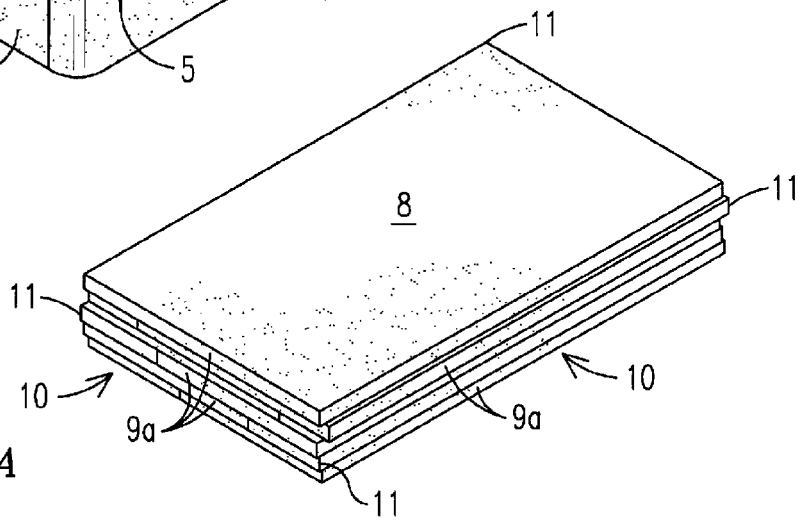
FIG. 2A is a top perspective view of a foam core of a mattress of the present invention.

With reference to FIG. 2A, a top perspective view of a foam core 8 of a mattress the present invention is illustrated. The foam core 8 is made up of various layers of foam 9*a*, preferably latex foam, thereby leaving uneven edges 10 and corners 11. Although the method described herein is used with a layered foam core 8, the method may also be used with a solid foam core to provide correctly shaped corners and a solid perimeter edge and to prevent uneven displacement and spreading of the solid foam core.

Figure 2B:
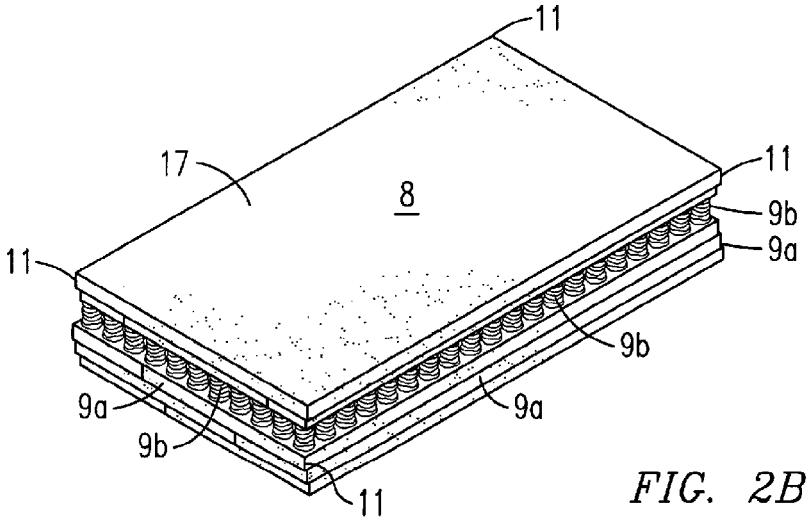
FIG. 2B is a top perspective view of a foam core of a mattress of the present invention having a layer of micro-coil springs.

With reference to FIG. 2B, a top perspective view of a foam core 8 of a mattress of the present invention having a layer of micro-coil springs 9*b* is illustrated. One or more layers of micro-coil springs 9*b* may be located between any of the layers of foam 9*a* to provide more buoyancy and springiness in the foam core 8. However, at least one layer of micro-coil springs 9*b* is preferably placed proximate to an upper surface 17 of the foam core 8 to provide the maximum benefit. The one or more micro-coil spring layers 9*b* may also be placed in a central location within the foam core 8 and framed by a layer of foam 9*a* on the edges of the foam core 8 to provide a denser edge to the mattress. The method of wrapping a foam core 8 described herein may also be used on a foam core 8 having one or more micro-coil spring layers 9*b* to provide correctly shaped corners 11 and a solid perimeter edge and to prevent uneven displacement and spreading of the foam core 8.

Figure 3:
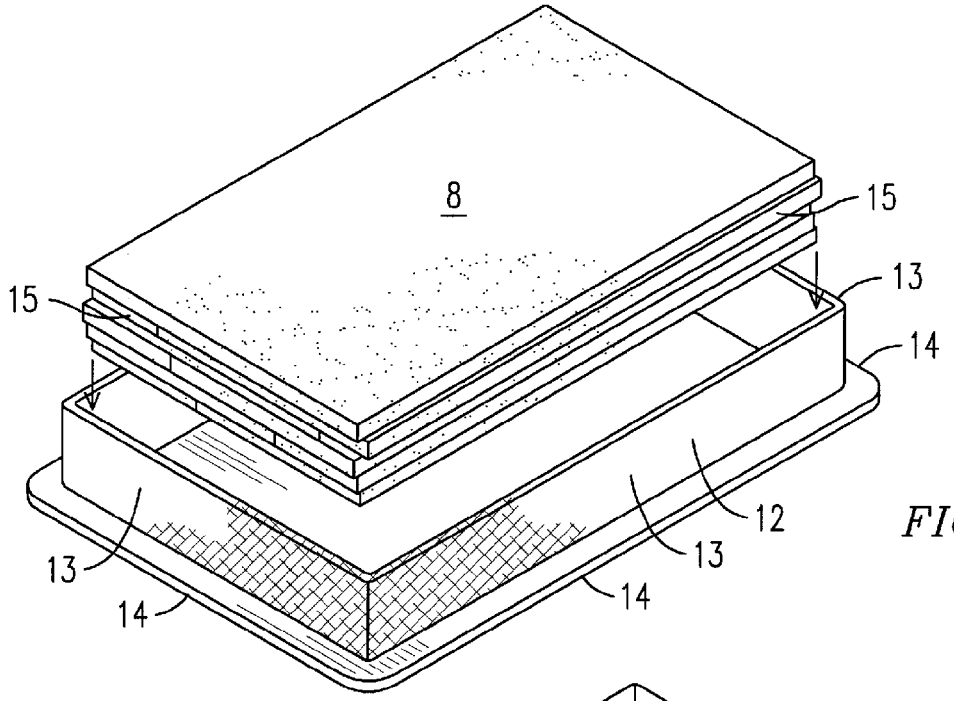
FIG. 3 is an exploded top perspective view of a foam core of the present invention and a bottom cover of the mattress of the present invention.

With reference to FIG. 3, an exploded top perspective view of a foam core 8 of the present invention and a bottom cover 12 of the mattress of the present invention is illustrated. The foam core 8 is placed on top of the bottom cover 12. Then, bottom flanges 13 extending upward from the perimeter 14 of the bottom cover 12 are pulled up around side walls 15 of the foam core 8.

Figure 4:
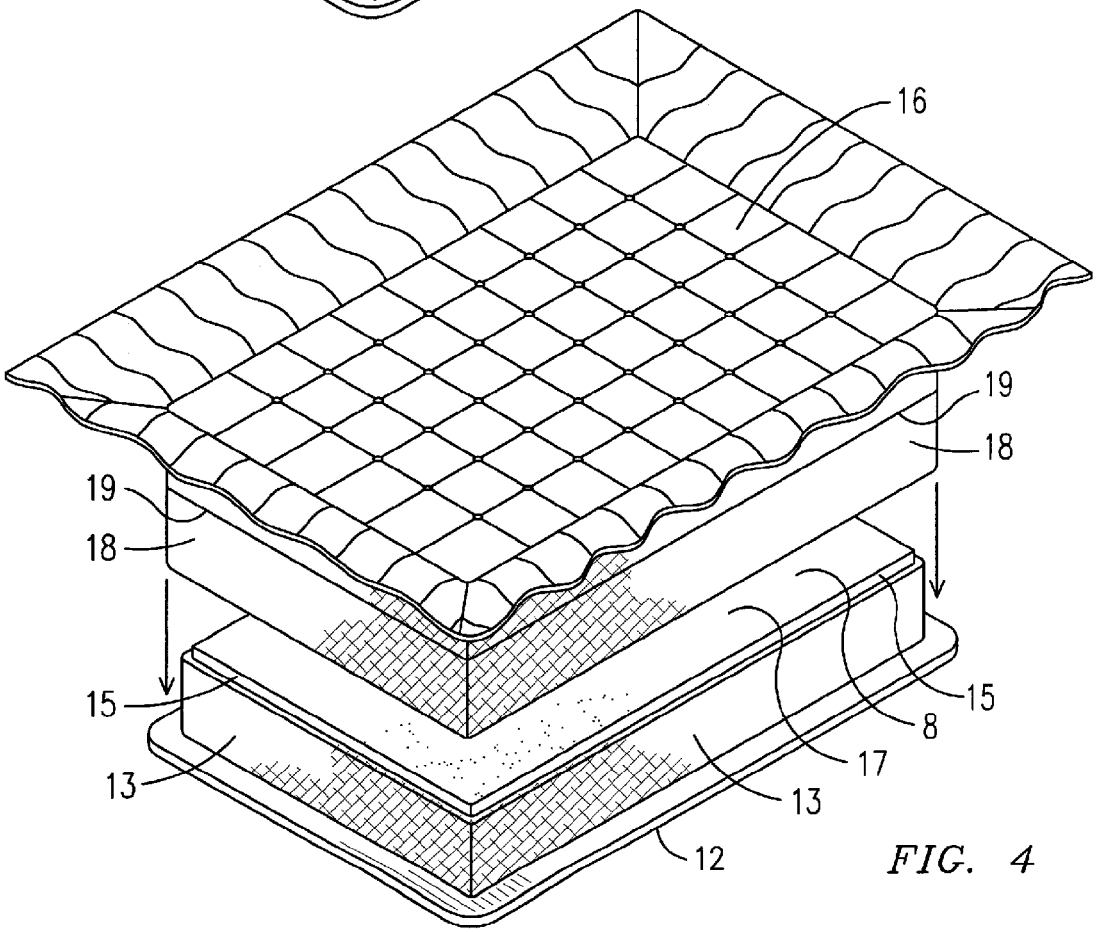
FIG. 4 is a partially exploded top perspective view of a foam core of the present invention already placed in a bottom cover and a top cover of the mattress of the present invention.
Figure 5:
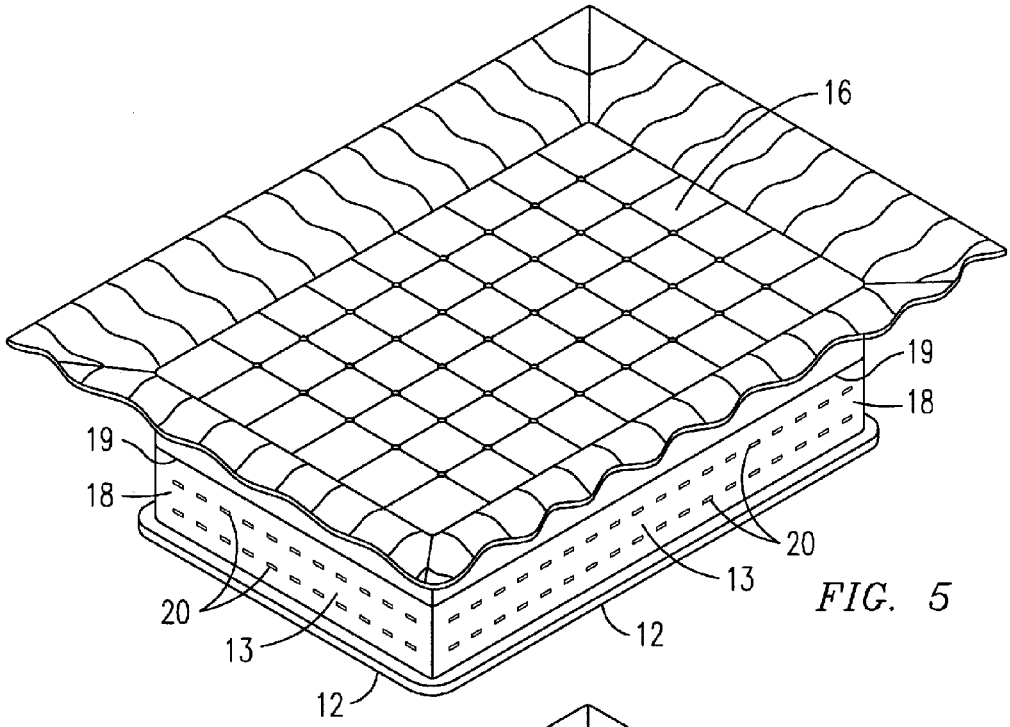
FIG. 5 is a top perspective view of the flanges of the top cover and the flanges of the bottom cover secured to the side walls using staples.
Figure 6:
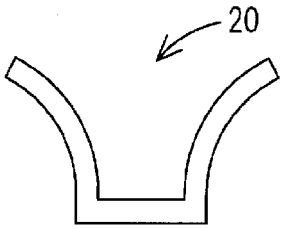
FIG. 6 is a front view of a flair staple.

With reference to FIG. 4, a partially exploded top perspective view of a foam core 8 of the present invention already placed on a bottom cover 12 and a top cover 16 of the mattress of the present invention is illustrated. After the foam core 8 is place on top of the bottom cover 12 and the bottom flanges 13 of the bottom cover 12 are pulled up around the side walls 15 of the foam core 8, the top cover 16 is placed over an upper surface 17 of the foam core 8 and top flanges 18 extending downward from the perimeter 19 of the top cover 16 are pulled down and around the side walls 15 of the foam core 8 and the bottom flanges 13. The bottom flanges 13 and top flanges 18 are preferably a fabric material. Then, the top flanges 18 and the bottom flanges 13 are secured to the side walls 15 by stapling through the flanges 13, 18 into the side walls 15, preferably using flair staples 20 that spread apart after entering the foam core 8, as illustrated in FIGS. 5 and 6, respectively.

Figure 7:
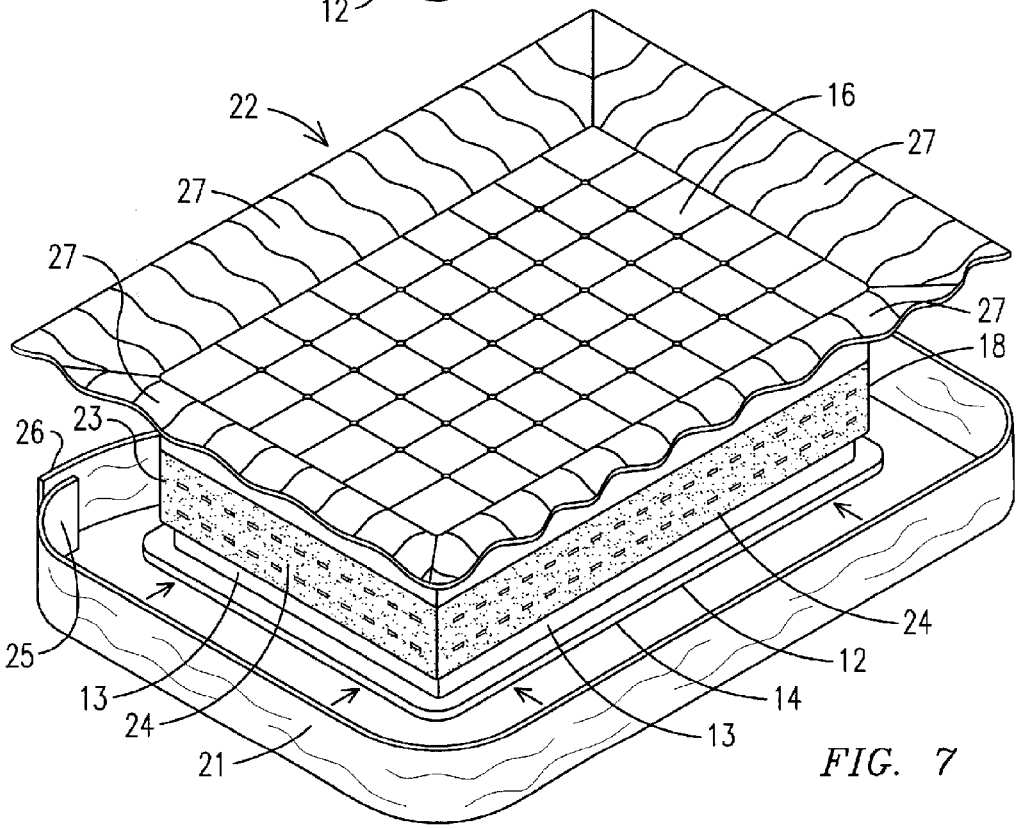
FIG. 7 is a partially exploded top perspective view of a non-woven strip of fabric and mattress of the present invention.
Figure 8:
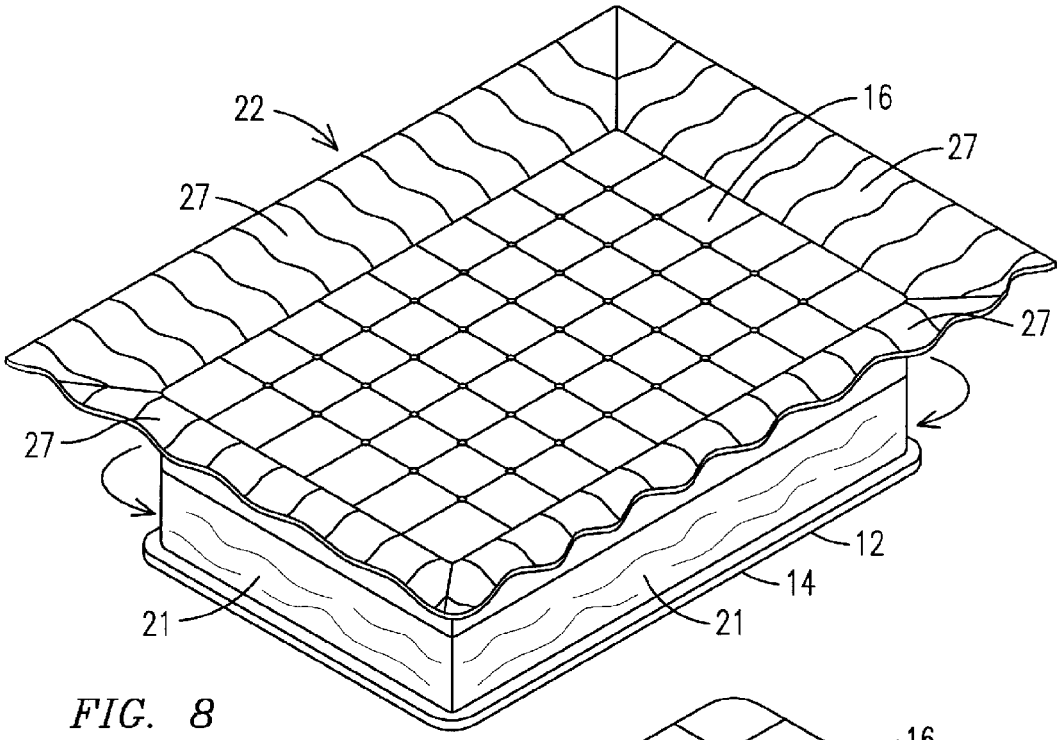
FIG. 8 is a top perspective view of a foam core wrapped in a non-woven strip of fabric of the present invention.
Figure 9:
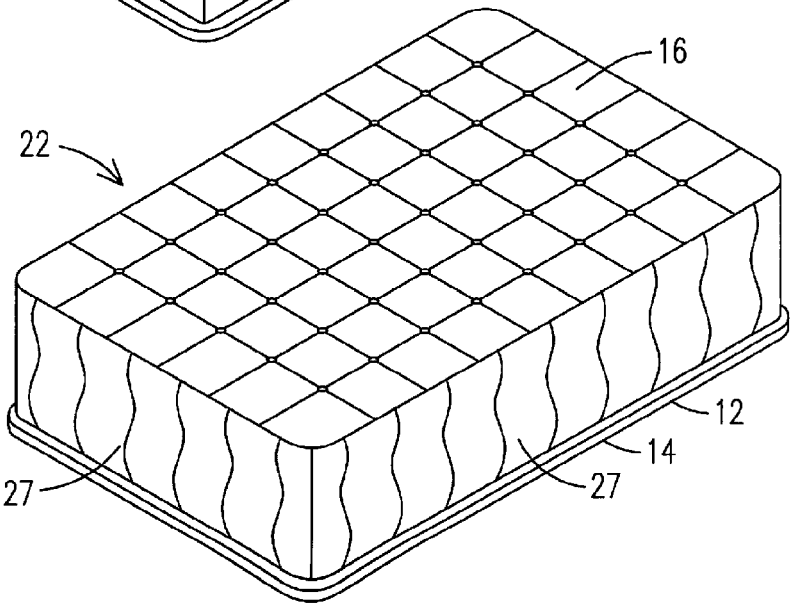
FIG. 9 is a top perspective view of a mattress of the present invention having the side panels of the top cover folded and sewn to the bottom panel.

With reference to FIG. 7, a partially exploded top perspective view of a non-woven strip of fabric 21 and mattress 22 of the present invention is illustrated. After the flanges 13 and 18 are secured to the side walls 15 of the foam core 8, a non-woven strip of fabric 21 or other non-flexible non-stretchable material is secured the outer surface 23 of the top flange 18 using an adhesive 24, such as a water based glue, which may be sprayed on the outer surface 23 of the top flange 18 (or the an outer surface of the bottom flange if the bottom flange is covering the top flange). A first end 25 of the non-woven strip of fabric 21 is then secured to the top flange 18 and wrapped around the side walls 15 of the foam core 8. As the non-woven strip of fabric 21 is wrapped around the foam core 8, the non-woven strip of fabric 21 may be pulled with varying degrees of force to apply the proper amount of tension and inward pressure on the side walls 15 of the foam core 8 to create straight side walls 15 and properly formed corners 11. Then, a second end 26 of the non-woven strip of fabric 21 is secured to the top flange 18 using the adhesive 24. The non-woven strip of fabric 21 may then be smoothed out. Finally, side cover panels 27 extending from the top cover 16 may be folded down over the non-woven strip of fabric 21 and sewn to the perimeter 14 of the bottom cover 12, thereby completely encapsulating the foam core 8, flanges 13, 18 and non-woven strip of fabric 21 in the top cover 16, sided cove panels 27 and the bottom cover 12, as illustrated in FIGS. 8 and 9, respectively.

Figure 10:
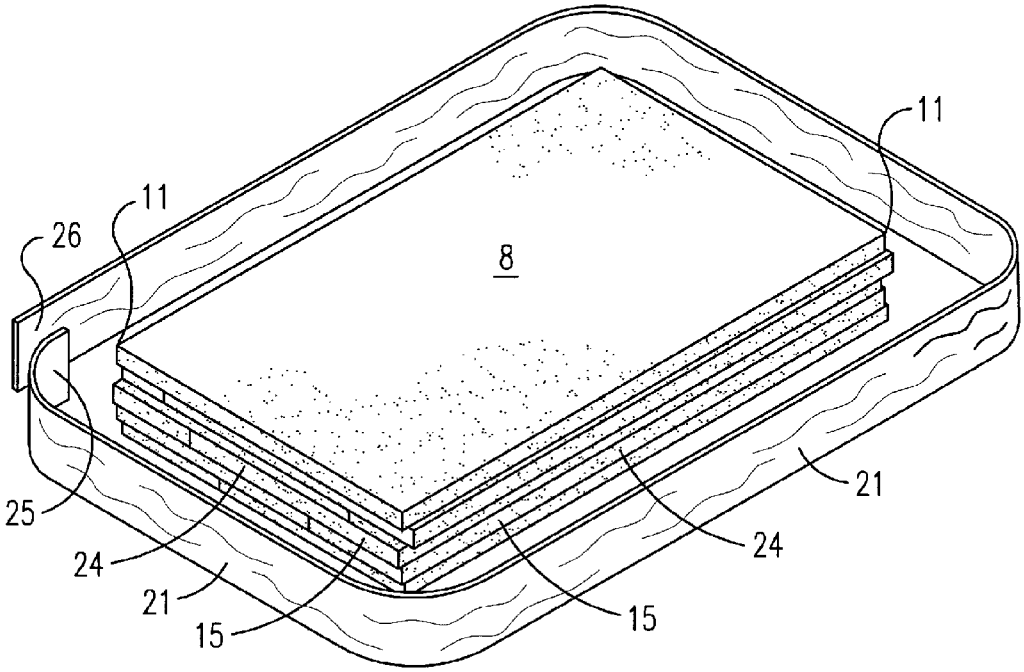
FIG. 10 is a partially exploded top perspective view of a non-woven strip of fabric and foam core of the present invention.
Figure 11:
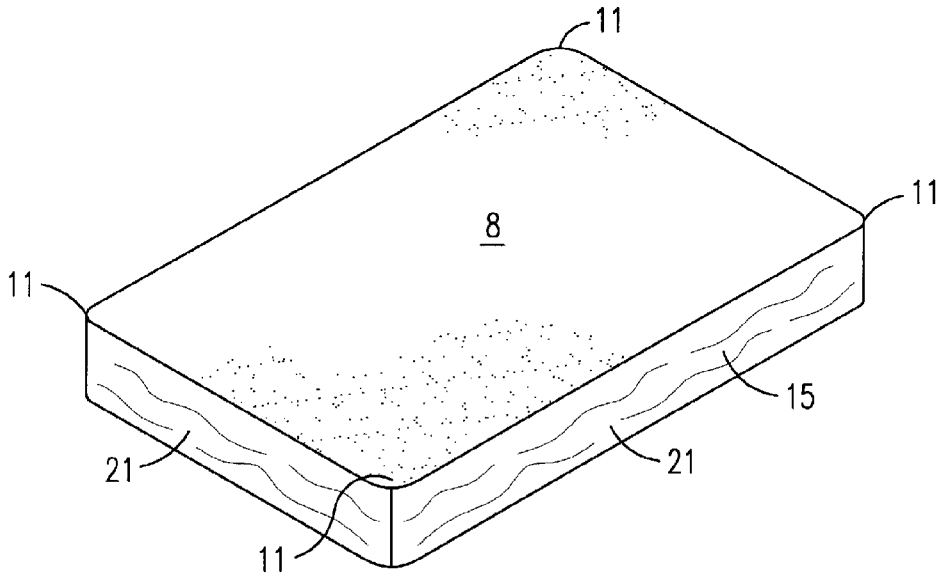
FIG. 11 is a foam core wrapped in non-woven fabric.

With reference to FIG. 10, a partially exploded top perspective view of a non-woven strip of fabric 21 and foam core 8 of the present invention is illustrated. The method of the present invention may also be used with other mattress covers, such as sock mattress covers, wherein the foam core 8 is directly wrapped with a non-woven strip of fabric 21 or other non-flexible non-stretchable material using an adhesive 24, such as a water based glue, which is sprayed directly on the side walls 15 of the foam core 8. A first end 25 of the non-woven strip of fabric 21 is then secured to the side walls 15 and wrapped around the side walls 15 of the foam core 8. As the non-woven strip of fabric 21 is wrapped around the foam core 8, the non-woven strip of fabric 21 may be pulled with varying degrees of force to apply the proper amount of tension and inward pressure on the side walls 15 of the foam core 8 to create straight side walls 15 and properly formed corners 11. Then, a second end 26 of the non-woven strip of fabric 21 is secured using the adhesive 24. The non-woven strip of fabric 21 may then be smoothed out. After the non-woven strip of fabric 21 has been smoothed out, as illustrated in FIG. 11, a cover, such as a sock cover, may be used to cover the wrapped foam core 8.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

We claim:

1. A perimeter-wrapped mattress comprising:

a foam core having planar top and bottom surfaces, side walls and corners; and a bottom panel having bottom flanges extending upward from a perimeter edge, thereby surrounding the side walls of the foam core;

a top panel having top flanges extending downward from a perimeter edge, thereby surrounding the side walls of the foam core;

a side cover that covers the side walls of the foam core to secure the top cover to the bottom cover;

a strip of fabric wrapped around a perimeter of the sidewalls and corners; and said strip of fabric is secured to the side walls using an adhesive.

2. The perimeter-wrapped mattress of claim 1 wherein:

said top flanges and bottom flanges are secured to the side walls using staples.

3. The perimeter-wrapped mattress of claim 1 wherein:

said strip of fabric is a non-woven strip of fabric.

4. The perimeter-wrapped mattress of claim 1 wherein:

said foam core comprises a plurality of layers of foam.

5. The perimeter-wrapped mattress of claim 1 further comprising:

at least one micro-coil layer located in the foam core.

6. A method for manufacturing a perimeter-wrapped mattress having a foam core having planar top and bottom surfaces, side walls and corners, said method comprising the steps of:

wrapping the side walls and corners with a strip of fabric while exerting an inward pressure on the side walls and corners to create properly formed corners and side walls on the foam core; and said strip of fabric is secured to the side walls using an adhesive.

7. The method of claim 6 further comprising the steps of:

placing the foam core on a bottom panel having bottom flanges extending upward from a perimeter edge; and folding the bottom flanges upward, thereby surrounding the side walls of the foam core.

8. The method of claim 6 further comprising the steps of:

placing a top panel having top flanges extending downward from a perimeter edge over the foam core; and folding the top flanges downward, thereby surrounding the side walls of the foam core.

9. The method of claim 7 further comprising the step of:

securing a side cover to the perimeter edge of the bottom panel.

10. The method of claim 8 further comprising the step of:

securing a side cover to the perimeter edge of the top panel.

11. The method of claim 6 wherein:

said strip of fabric is a non-woven strip of fabric.

12. The method of claim 6 wherein:

said foam core comprises a plurality of layers of foam.

13. The method of claim 6 wherein:

at least one micro-coil layer located in the foam core.

* * * * *